United States Patent [19]

Ghibely

[11] Patent Number: 4,566,622

[45] Date of Patent: Jan. 28, 1986

[54] STRIKING APPARATUS FOR FASTENERS

[75] Inventor: Bruno Ghibely, Ahrensburg, Fed. Rep. of Germany

[73] Assignee: Esco Metallwaren Martin Hühnken

[21] Appl. No.: 602,443

[22] Filed: Apr. 20, 1984

[30] Foreign Application Priority Data

May 6, 1983 [DE] Fed. Rep. of Germany ... 8313386[U]

[51] Int. Cl.[4] ..... B25C 7/00

[52] U.S. Cl. ..... 227/120; 227/116; 227/130

[58] Field of Search ..... 227/120, 121, 130, 131, 227/109, 114, 115, 116

[56] References Cited

U.S. PATENT DOCUMENTS

| | | | |
|---|---|---|---|
| 2,117,743 | 5/1938 | Polzer | 227/121 |
| 2,690,561 | 10/1954 | Scheurmann | 227/120 X |
| 3,765,588 | 10/1973 | Frederickson | 227/115 X |
| 4,380,312 | 4/1983 | Landrus | 227/116 |
| 4,452,388 | 6/1984 | Fealey | 227/120 X |
| 4,463,888 | 8/1984 | Geist et al. | 227/109 |

FOREIGN PATENT DOCUMENTS

| | | | |
|---|---|---|---|
| 1309342 | 3/1973 | United Kingdom | 227/120 |

*Primary Examiner*—Paul A. Bell

*Attorney, Agent, or Firm*—Schroeder & Siegfried

[57] ABSTRACT

A fastener striking apparatus for fasteners, especially for staples, nails, etc., comprising a housing with a plunger to be struck arranged therein, a tool portion arranged at the housing containing a fastener channel with the plunger guided therein during the striking operation, and a magazine for the fasteners with the fasteners advanced therein with the aid of a spring-biased feeder in the direction of the fastener channel, with an adjustable resetting member provided which when in the normal position has a cam projecting into a recess formed in the tool portion on the side of the fastener channel opposite the magazine and which upon adjustment against the feeding direction of the fasteners in the magazine is adapted to be adjusted to such an extent that the respective foremost staple, together with the cam is disposed outside the fastener channel.

6 Claims, 6 Drawing Figures

STRIKING APPARATUS FOR FASTENERS

The innovation relates to a striking apparatus for fasteners, especially for staples, nails or the like, comprising a housing with a power-driven plunger arranged therein, a tool portion arranged at the housing, said tool portion containing a fastener channel with the plunger guided therein during the operation of striking, a magazine for the fasteners with the fasteners advanced therein with the aid of a spring-biased feeder in the direction of the fastener channel.

Such apparatuses have become known in the most various embodiments for commercial and private use. They differ from each other as regards the drive thereof. Apart from plungers driven by spring force there are apparatuses which operate using compressed air or electrical energy.

For commercial applications, in particular, staples and nails, especially, are used which are of considerable length. The plunger, therefore, must be driven with a sufficient amount of energy, in order to drive in the fastener in one single stroke. A second stroke is not to be taken into account because, according to the type of usual magazine arrangement, a new fastener is advanced into the channel as soon as the plunger has terminated its reverse stroke. A second stroke, thus would lead to the undesired exit of another fastener.

It may be imagined, indeed, with compressed air-controlled or electrically controlled apparatuses to have the plunger perform several strokes, with all the strokes making up the first drive-in stroke not taking place from the upper position of rest of the plunger but from a position disposed between the end positions so as to prevent the introduction of another fastener into the channel. But such a control is relatively complicated and, with electrically operated striker apparatuses, above all, may lead to an overheating of the driver coil.

It is the object of the innovation to provide a striking apparatus for fasteners, especially for staples, nails, or the like, the plunger of which may be used as an impact tool.

Thus an object of this invention is attained in accordance with the innovation in that an adjustable resetting member is provided comprising a cam which in the normal position projects into a recess of the tool portion on the side of the fastener channel opposite the magazine and which upon adjustment of the resetting member against the feeding direction of the fasteners in the magazine may be adjusted in such a degree that the respective foremost staple together with the cam is outside the fastener channel.

With the striking apparatus according to the innovation of the resetting member, it may serve to move the fasteners such as the bar of staples, for example, backwards in the magazine against the feeding spring, so that the fastener channel is completely free. With the resetting member in this position, the fastener plunger may perform as many impact blows as may be desired, and may thus be used as an impact tool for the striking of particularly long fasteners, for example, into a hard or solid workpiece.

The measure according to the innovation requires but a minimum of extra expenditure and may be utilized for many types of striking apparatuses.

There are various constructional possibilities for the embodiment and the mounting of the resetting member, in order to attain the effect according to the innovation.

In one embodiment of the innovation provision is made for the resetting member to comprise a one-piece pusher slidingly supported at the magazine or at the tool portion, and an outwardly pointing actuating portion.

The use of a pusher is particularly advantageous if, according to another embodiment of the innovation, the tool portion comprises a nose piece which is U-shaped in cross section and is connected to it in front and has its legs disposed laterally in close contact against the magazine, while the pusher is supported slidingly at one of the legs with the cam guided through a recess of the leg or, when in the normal position, being disposed in a recess of the web of the U-shaped nose piece. Thus, the covering of the fastener channel is interrupted through the recess in the leg and the web, respectively, of the U-shaped nose piece. In the position of rest of the pusher, this recess is covered by a portion of the pusher so that no object can arrive in the fastener channel from outside.

The pusher, upon actuation, is constantly biased into the position of rest through the bias of the feeder spring. It is imaginable when using the striker apparatus as an impact tool to constantly retain the manually operated pusher in the retracted position during this operational step. As an alternative, provision is made in one embodiment of the innovation for the resetting member to be arrestable in the working position by snapping engagement. The snapping engagement, according to a further embodiment of the innovation, cannot be overcome by the feeding force of the spring, but may be disengaged by manual actuation.

In the following, one example of embodiment of the innovation will be described in more detail by way of drawings.

Figure 1:
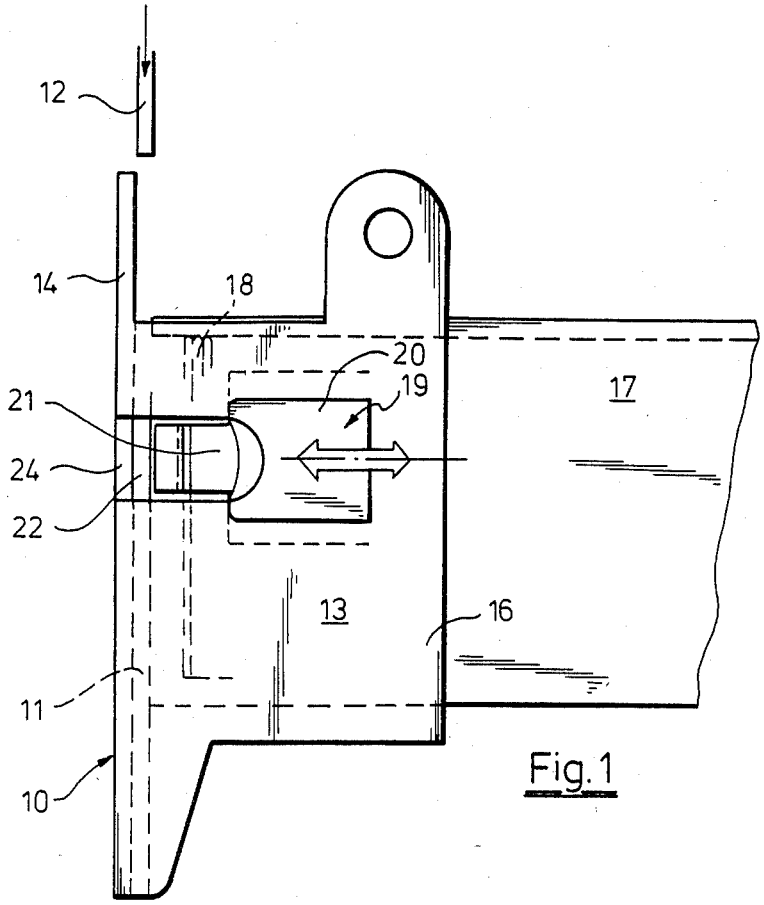
FIG. 1 shows diammatically a side view of the forward lower portion of striking apparatus.

Prior to enlarging on the details shown in the drawings, it is to be stated that each of the individual features shown and described is of essential importance to the innovation either by itself or in connection with features of the claims.

At the housing (not shown) of a nailing apparatus such as an electric nailing apparatus, for example, a tool portion 10 is arranged having a fastener channel 11 formed therein. The fastener channel guides a striking plunger 12, which is correspondingly supported in the housing and is driven by means of a magnetic coil. The tool portion 10 is essentially formed by a nose piece 13 U-shaped in cross section, and extending over the end of fastener channel 11 to form a web 14 as well as legs 15, 16 down each side. The nose piece 13 accommodates a magazine 17 for U-shaped staples 18. The legs of the staples 18 are relatively long. The staples 18 which are arranged one after the other in the form of a bar on a carrier (not shown) are advanced by means of a pusher 30 which is biased by a staple spring 31 having a stop 32, thus urging the staples 18 in the direction of the fastener channel 11. When in the position of rest, the striker plunger 12 normally is disposed outside the fastener channel 11, so that the respective foremost staple is already situtated in the striker channel when the drive-in apparatus is actuated.

Figure 2:
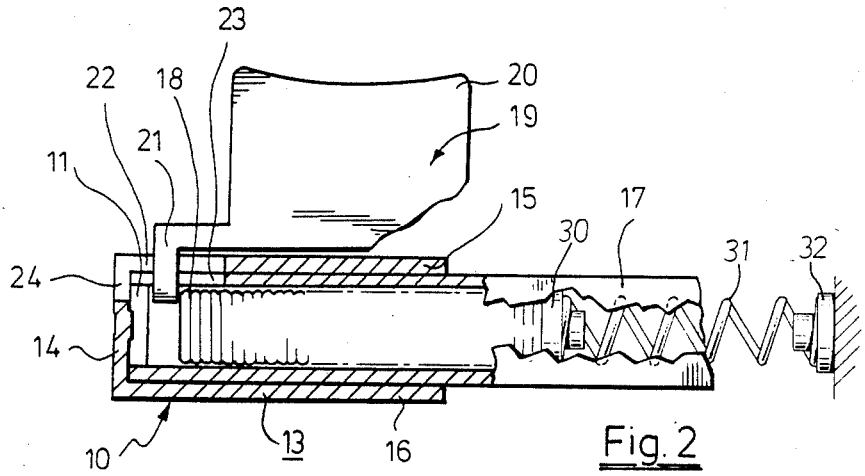
FIG. 2 shows a sectional view of the representation according to FIG. 1.
Figure 3:
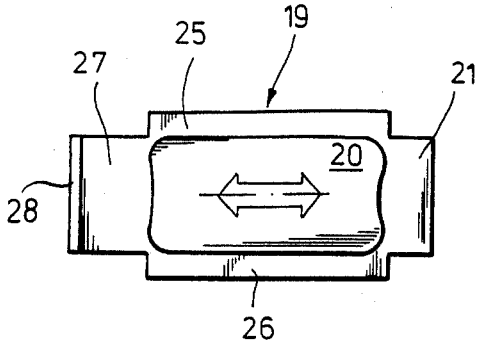
FIG. 3 shows a top plan view of a pusher of the apparatus according to FIG. 1.
Figure 4:
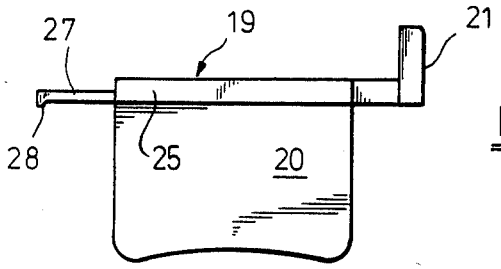
FIG. 4 shows a side view of the pusher according to FIG. 3.

As may be seen from FIG. 2, the web 14 of the nose piece 13 lies in close contact against the end face of the magazine 17, while the legs 15, 16 lie in close contact against the outer surface of the magazine 17. A pusher or feeder 19 is supported at the leg 15 of the structural member 10. Said feeder comprises a block-shaped actuation portion 20 with an L-shaped cam 21 integrally formed thereat towards the front thereof, said cam having a leg extending normal to the magazine 17 and projecting into the magazine via a recess 22 formed in the leg 15 and a recess 23 formed in the wall of the magazine 17. With the feeder 19 in the position as shown, the staples 18 are kept in front of the fastener channel against the direction of feeding, so that the striker plunger 12 may strike as many blows as may be desired without any staple 18 being forced to exit. In the position of rest (not shown here) the push member 19 is pushed further to the front, so that the portion of the cam 11 extending normal to the magazine 17 is disposed within a recess 24 in the web 14. Owing thereto, the cam 21 is likewise disposed outside the fastener channel, and the fastener apparatus may be operated in the usual manner.

Another possible embodiment of the pusher member 19 is shown in FIGS. 3 to 6. It will be noted that in addition to the cam 21 there are two ledges 25, 26 formed integrally thereat laterally level with the cam 21 which are engaging behind the opening formed in the leg 15 which is not shown in FIGS. 1 and 2, in order to achieve a pushing and sliding effect. A lug 27 with a small nose-shaped projection 28 is furthermore formed integrally on the side opposite the cam 21 in a sense opposed to that of the normally extending leg of the cam 21. The cam 21 serves an arresting purpose, in order to retain the pusher member 19 in the position as shown in FIG. 2 and to make possible the use of the striker apparatus as a percussion apparatus.

Figure 5:
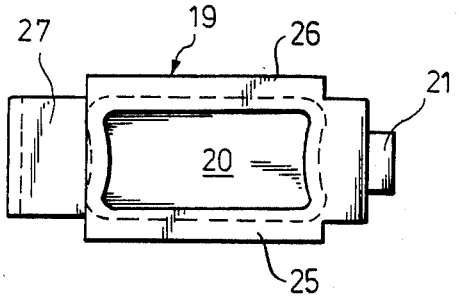
FIG. 5 shows a bottom plan view of the pusher according to FIG. 3.
Figure 6:
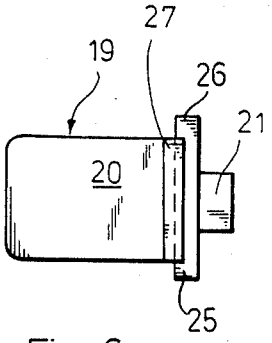
FIG. 6 shows another side view of the pusher according to FIG. 3.

The pusher member as shown in FIGS. 3 to 6 is formed in one piece of synthetic material with the actuation portion 20 being hollow as will be recognized from FIG. 5.

I claim:

1. A fastener striking apparatus for fasteners, especially for staples, nails, etc., comprising a housing with a power-driven plunger arranged therein, a tool portion containing a fastener channel with the plunger guided therein during the operation of striking, and a magazine for the fasteners with the fasteners advanced therein with the aid of a spring-biased feeder in the direction of the fastener channel, characterized in that an adjustable resetting member (19) is provided which when in the normal position has a cam (21) projecting into a recess (24) of the tool portion (10) on the side of the fastener channel (11) opposite the magazine (17) and which upon adjustment against the feeding direction of the fasteners (18) in the magazine is adjustable to such an extent that the respective foremost staple (18) together with the cam (21) is disposed outside the fastener channel (11).

2. A fastener striking apparatus according to claim 1, characterized in that the resetting member is a one-piece pusher member (19) which is slidingly supported at the magazine (17) and comprises an outwardly pointing actuation portion (20).

3. A fastener striking apparatus according to claim 2, characterized in that the tool portion (10) comprises a nose piece (13) U-shaped in cross section and extending over the end of fastener channel 11 and having its legs (15,16) disposed laterally against the magazine (17) with the pusher member (19) being slidingly supported at one leg (15) and the cam (21) guided through a recess (22) formed in the leg (15) and disposed in a recess (24) of the web (14) of the U-shaped nose piece (13) when in the normal position.

4. A fastener striking apparatus to any one of the claims 1 to 3, characterized in that the resetting member (19) is adapted to be arrested in the working position by an arresting engagement.

5. A fastener striking apparatus according to claim 4, characterized in that the arresting engagement cannot be overcome by the biasing power of the spring at the feeder but may be released by manual operation.

6. A fastener striking apparatus according to any one of the claims 1 to 3, characterized in that the pusher member (19) is formed in one piece of synthetic material.

* * * * *

UNITED STATES PATENT AND TRADEMARK OFFICE

CERTIFICATE OF CORRECTION

PATENT NO. : 4,566,622

DATED : January 28, 1986

INVENTOR(S) : Bruno Ghibely

It is certified that error appears in the above-identified patent and that said Letters Patent are hereby corrected as shown below:

Column 2, Line 35 the word after shows should read --diagrammatically-- not "diammatically".

Column 3, Line 3 delete the word "striker".

Column 3, Line 3 delete the word "drive-in" and substitute the word --striker--.

Column 4, Line 34 after the word "apparatus" insert the word --according--.

Signed and Sealed this

*Twenty-second* Day of *April 1986*

[SEAL]

*Attest:*

DONALD J. QUIGG

*Attesting Officer*

*Commissioner of Patents and Trademarks*